US010959528B2

(12) United States Patent
Fletcher et al.

(10) Patent No.: US 10,959,528 B2
(45) Date of Patent: Mar. 30, 2021

(54) ACTIVE SEAT WITH STORAGE

(71) Applicant: The Prophet Corporation, Owatonna, MN (US)

(72) Inventors: Laura Ann Fletcher, Owatonna, MN (US); Ryan William Rasell, Apple Valley, MN (US)

(73) Assignee: The Prophet Corporation, Owatonna, MN (US)

( * ) Notice: Subject to any disclaimer, the term of this patent is extended or adjusted under 35 U.S.C. 154(b) by 0 days.

(21) Appl. No.: 16/431,369

(22) Filed: Jun. 4, 2019

(65) Prior Publication Data

US 2020/0383489 A1 Dec. 10, 2020

(51) Int. Cl.

| | |
|---|---|
| ***A47C 9/00*** | (2006.01) |
| ***A47C 9/02*** | (2006.01) |
| ***A47C 3/029*** | (2006.01) |
| ***A47C 7/62*** | (2006.01) |
| *A47C 9/10* | (2006.01) |
| *A47C 13/00* | (2006.01) |
| *A47C 3/16* | (2006.01) |

(52) U.S. Cl.

CPC ..... *A47C 9/02* (2013.01); *A47C 3/029* (2013.01); *A47C 7/622* (2018.08); *A47C 3/16* (2013.01); *A47C 7/628* (2018.08); *A47C 9/10* (2013.01); *A47C 13/00* (2013.01)

(58) Field of Classification Search

CPC ..... A47C 9/02; A47C 7/622; A47C 3/029; A47C 3/16; A47C 9/10; A47C 13/00; A47C 7/628; A47C 9/00–105

See application file for complete search history.

(56) References Cited

U.S. PATENT DOCUMENTS

| | | | | |
|---|---|---|---|---|
| 2,049,539 A * | 8/1936 | Greenwood | A47C 9/02 248/152 |
| 2,552,693 A * | 5/1951 | Smith | A47C 3/16 297/462 |
| 2,623,633 A * | 12/1952 | Bladow | A45F 3/46 206/499 |
| 2,742,953 A * | 4/1956 | Kudrna | A47C 3/24 248/405 |
| D198,679 S | 7/1964 | Cartner | |
| 3,312,437 A * | 4/1967 | Barth | A47C 3/029 248/158 |
| 3,563,605 A | 2/1971 | Pinkas | |
| 3,604,749 A | 9/1971 | Parmett et al. | |

(Continued)

FOREIGN PATENT DOCUMENTS

JP 8-112155 A 5/1995

OTHER PUBLICATIONS

Plastic Round Stools, Retrieved May 2, 2018 from URL: <http://www.umaplastics.com/plastic-round-stools.html>, 5 pages.

(Continued)

*Primary Examiner* — Syed A Islam

(74) *Attorney, Agent, or Firm* — Merchant & Gould P.C.

(57) ABSTRACT

An active stool includes a base and a cover. The base defines an interior cavity accessible through an open end of the base. The cover removably mounts to the base to cover the open end. The cover defines a seat for a user. The base is configured to tilt along at least one rocking path. Certain types of bases are configured to tilt along multiple rocking paths.

19 Claims, 8 Drawing Sheets

(56) References Cited

U.S. PATENT DOCUMENTS

| | | | | |
|---|---|---|---|---|
| D228,095 | S | 8/1973 | Schmitt | |
| 3,751,845 | A * | 8/1973 | van Leeuwen | A01K 97/05 43/56 |
| D232,499 | S | 8/1974 | Martinelli | |
| D232,504 | S | 8/1974 | Archinal | |
| D234,933 | S | 4/1975 | Burke | |
| 4,084,273 | A * | 4/1978 | Haynes | A47D 13/06 297/270.1 |
| 4,232,901 | A * | 11/1980 | Harrington | A47C 16/025 297/423.45 |
| 4,845,881 | A * | 7/1989 | Ward | A01K 97/22 43/21.2 |
| 5,112,103 | A * | 5/1992 | Downer | A47C 3/029 297/188.12 |
| 5,226,865 | A | 7/1993 | Chin | |
| D498,067 | S | 11/2004 | Van Dyke | |
| 7,341,314 | B1 * | 3/2008 | Boyd | A47C 9/10 297/188.09 |
| D586,574 | S | 2/2009 | Gomree | |
| D625,931 | S | 10/2010 | Estrup | |
| D647,313 | S | 10/2011 | Chen | |
| D650,184 | S | 12/2011 | Hsu | |
| D671,757 | S | 12/2012 | Walker et al. | |
| 8,764,116 | B2 * | 7/2014 | Weber | A47C 3/029 297/423.43 |
| 9,010,867 | B2 * | 4/2015 | Martin | A47C 3/029 297/271.5 |
| D728,951 | S | 5/2015 | Yoshida | |
| 9,078,526 | B1 * | 7/2015 | Kammeyer | A47C 13/00 |
| 9,138,058 | B2 * | 9/2015 | Koolhaas | A47C 3/16 |
| 9,167,899 | B2 | 10/2015 | Jackson | |
| D767,290 | S | 9/2016 | Walser | |
| 9,567,135 | B1 * | 2/2017 | Spadaccini | A47C 7/62 |
| D791,523 | S | 7/2017 | Bernard | |
| D809,309 | S | 2/2018 | Theesfeld | |
| D809,310 | S | 2/2018 | Mathur et al. | |
| D809,809 | S | 2/2018 | Theesfeld et al. | |
| D812,919 | S | 3/2018 | Kim | |
| 9,974,391 | B2 * | 5/2018 | Wan | A47C 3/16 |
| D830,710 | S | 10/2018 | Harguth et al. | |
| 10,258,160 | B2 * | 4/2019 | Risdall | A47C 3/38 |
| 10,390,629 | B2 * | 8/2019 | Phillips | A47D 1/04 |
| 10,517,399 | B2 * | 12/2019 | Harguth | A47C 3/029 |
| 2008/0265631 | A1 * | 10/2008 | Quicoy | A47C 16/02 297/42 |
| 2010/0066139 | A1 | 3/2010 | Woodring | |
| 2010/0244501 | A1 * | 9/2010 | Chiang | A47C 13/00 297/118 |
| 2019/0098998 | A1 | 4/2019 | Harguth et al. | |
| 2020/0022499 | A1 * | 1/2020 | Davidson | A47C 7/006 |

OTHER PUBLICATIONS

Play with a Purpose Catalog; Spring 2017; © 2017 Gopher Sport; 4 pages.

Thick plastic small round stools, home adult children bathroom stool, changing his shoes stool, Retrieved May 2, 2018 from URL: <https://www.aliexpress.com/item/Thick-plastic-small-round-stools-home-adult-children-bathroom-stool-changing-his-shoes-stool/32507580751.html, 17 pages.

TiltED Active Seats, Retrieved May 2, 2018 from URL: https://www.gophersport.com/pe/active-classroom/tilted-active-seats?item=25259&pt_source=googleads&pt_med i um =cpc&pt_campaign=Shopping_-_%E2%80%A6, 2 pages.

* cited by examiner

ACTIVE SEAT WITH STORAGE

BACKGROUND

Active seating allows a user freedom of movement while remaining seated. For example, a user may be able to pivot, rotate, or otherwise move the seat while sitting in the seat. Other seating includes pedals or other structures that can be moved by the user while the user remains seated. Improvements are desired.

SUMMARY

Some aspects of the disclosure are directed to an active stool providing storage for items. For example, such an active stool could be used in a classroom setting. A child can sit on the active stool during lessons and store items (e.g., books, backpack, writing implements, paper, art supplies, gym clothes, or any desired items) within a cavity defined by the active stool.

The active stool includes a base and a cover. The base has a tilting surface that defines at least one rocking path along which the base can tilt. The base also defines a cavity accessible through an open end. The cover is mountable to the base to close the open end. The cover defines a seat on which the user sits when using the active stool.

In certain implementations, the base is configured to tilt along a plurality of rotationally offset rocking paths. In certain examples, the base defines a spherical cap opposite the open end.

In certain implementations, the seat is formed by a depression defined in the cover. In certain implementations, the seat extends over a majority of a cross-sectional area of the cover.

In certain implementations, the cover includes handles. In some examples, the handles are integral with the cover. In other examples, the handles are separate pieces mounted to the cover.

In certain implementations, the interior cavity extends along a majority of a height of the base. In certain implementations, a cross-sectional area of the interior cavity extends over a majority of a cross-sectional area of the base.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

The present disclosure is directed to an active stool providing storage for items.

Figure 1:
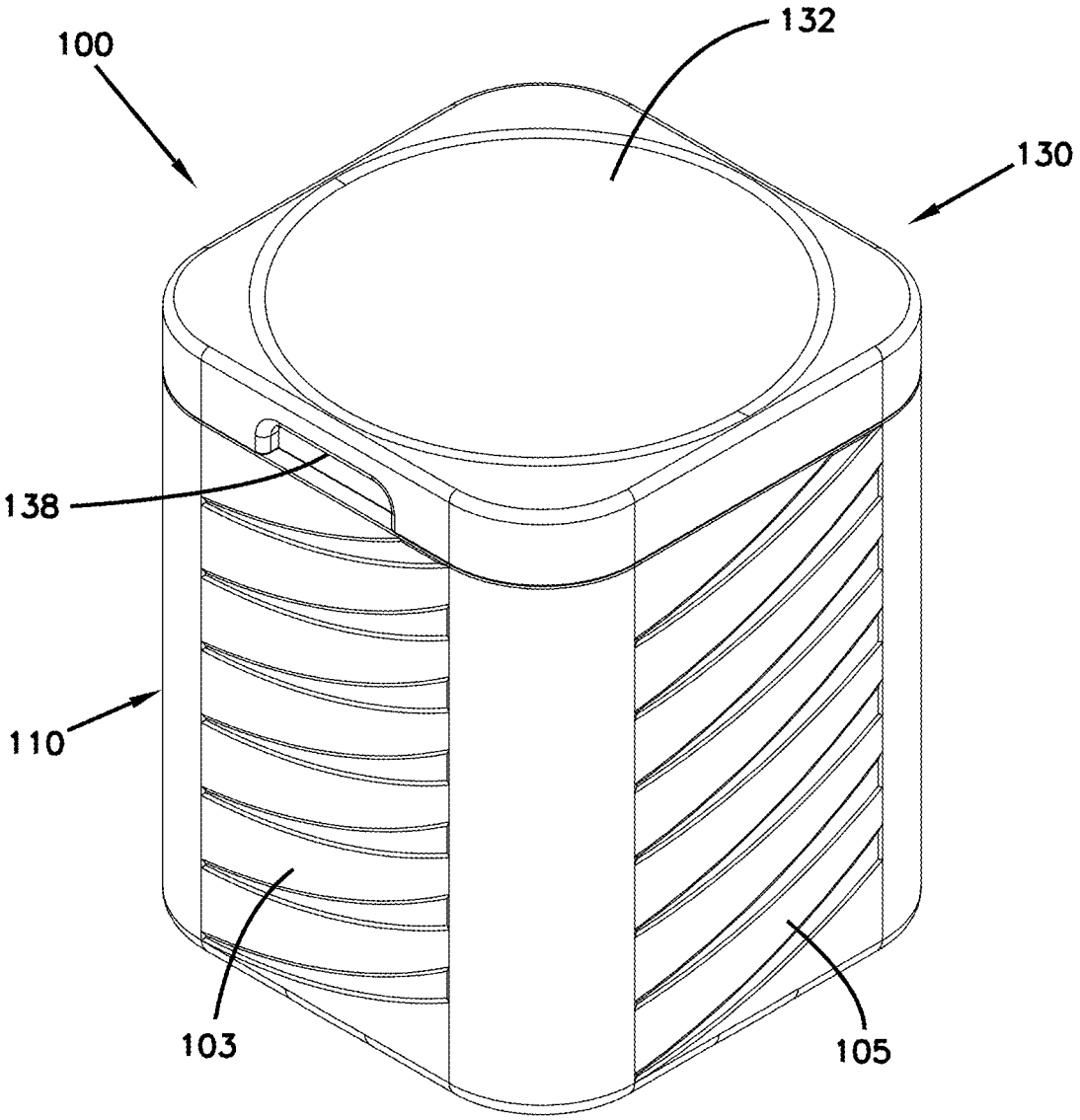
FIG. 1 is a top perspective view of an example active stool configured in accordance with the principles of the present disclosure, the active stool including a cover and a base.
Figure 2:
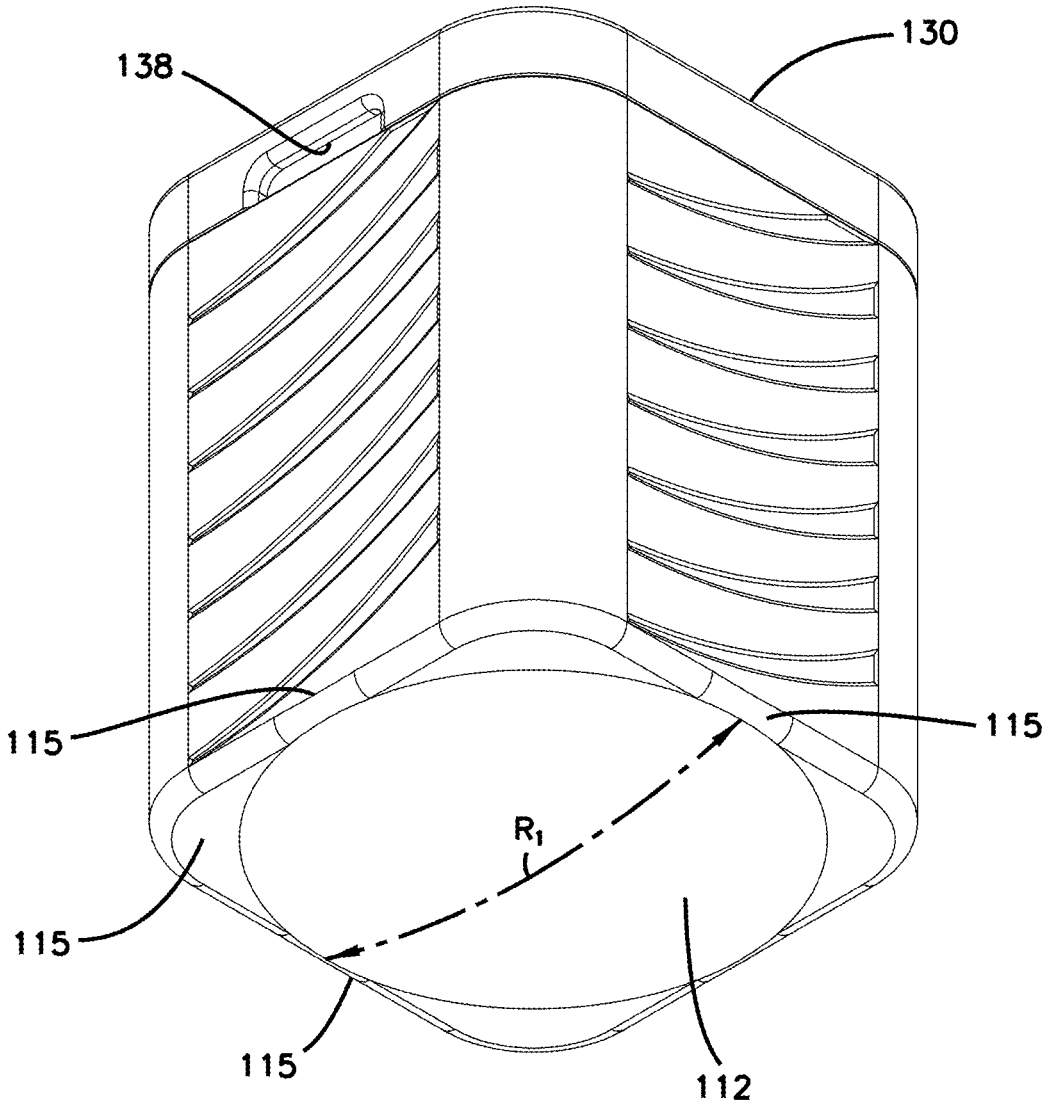
FIG. 2 is a bottom perspective view of the active stool of FIG. 1.

Referring to FIGS. 1 and 2, an example active stool 100 includes a seat 132 on which a user can sit when utilizing the stool 100. The active stool 100 also includes a convex surface 112 facing in an opposite direction from the seat 132. The convex surface 112 defines at least a first rocking path R1 along which the stool 100 can tilt. The convex surface 112 allows a user to rock on the stool 100 along at least the first rocking path R1.

The active stool 100 extends along a height H (FIG. 8) between the convex surface 112 and the top of the cover 130, along a width W (FIG. 3) between opposite sides 103, 104, and along a depth D (FIG. 3) between opposite ends 105, 106. In certain examples, the height H is greater than the width W and greater than the depth D. In certain examples, the width W is about equal to the depth D. The stool 100 has a central longitudinal axis L (FIGS. 4 and 5) extending along the height H of the stool 100.

In certain implementations, the active stool 100 has a generally rectangular outer transverse cross-sectional shape. In certain implementations, the active stool 100 has a generally square outer transverse cross-sectional shape. In certain implementations, the active stool 100 has a generally oblong outer transverse cross-sectional shape. In certain implementations, the active stool 100 has a generally circular outer transverse cross-sectional shape. In certain examples, the convex surface 112 fits within a footprint formed by the outer transverse cross-sectional shape of the active stool 100 (e.g., see FIG. 3).

Figure 3:
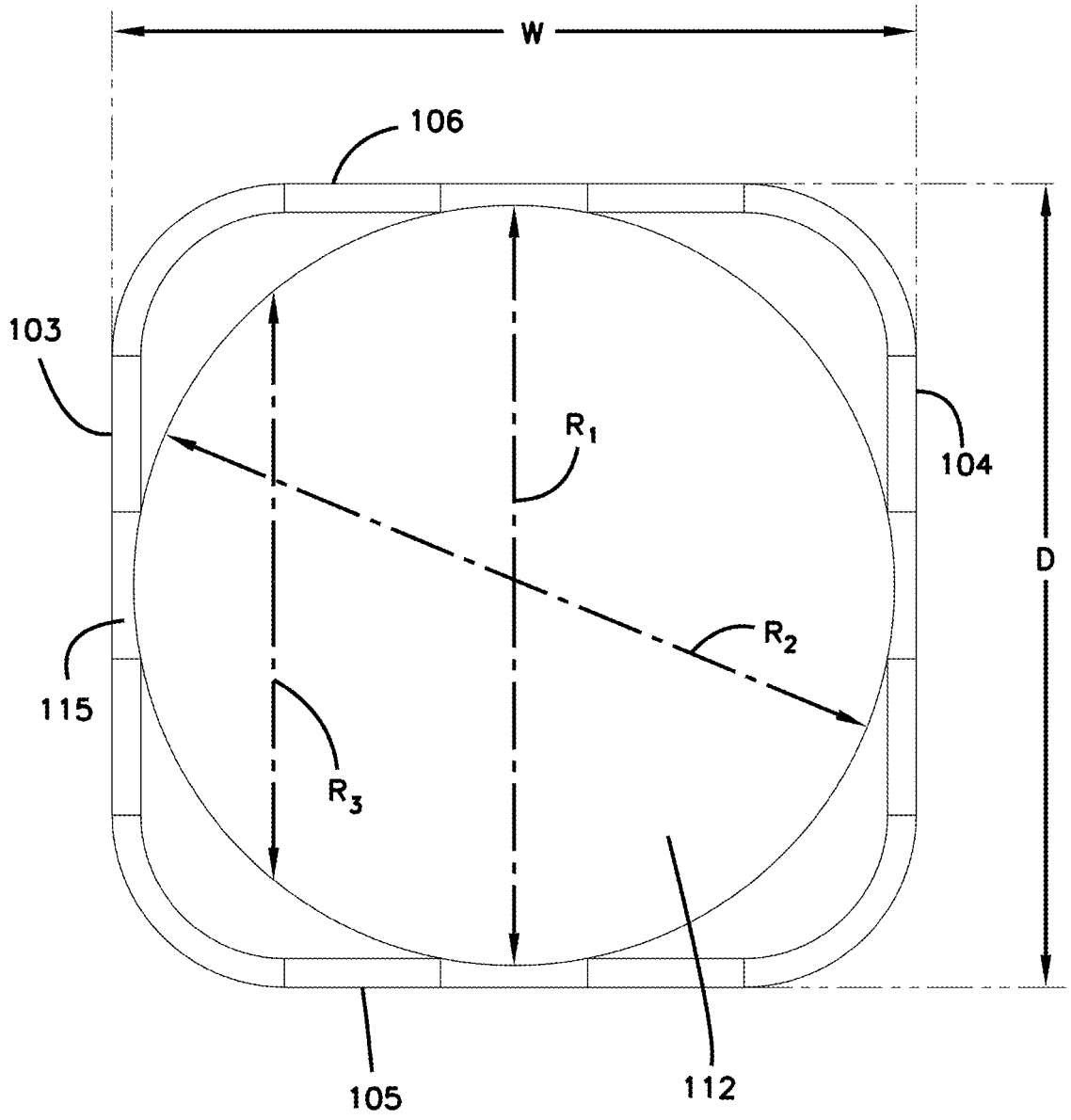
FIG. 3 is a bottom plan view of the active stool of FIG. 1.

As shown in FIG. 3, in certain examples, the convex surface 112 defines a plurality of rocking paths (e.g., see rocking paths R1, R2, and R3) along which the stool 100 can be tilted. For simplicity, three example rocking paths R1, R2, R3 are illustrated. It will be understood by a person skilled in the art that the convex surface 112 provides additional rocking paths. In certain examples, the rocking paths are rotationally offset from each other (e.g., compare rocking paths R1 and R2), thereby allowing a user to rock along different directions (e.g., forward-rearward, side-to-side, etc.). In certain examples, the rocking paths are laterally offset from each other (e.g., compare rocking paths R1 and R3), thereby allowing a user to rock in the same direction at different tilt angles. In an example, the convex surface 112 defines a spherical cap. Accordingly, the convex surface 112 has an infinite number of rocking paths. In other examples, the convex surface 112 may have other contoured shapes.

In certain examples, stop portions of the stool 100 extend laterally outwardly beyond the convex surface 112. In the example shown in FIG. 5, the stop portions surround the convex surface 112. The rocking paths R1, R2, R3 end at the stop portions 115. Accordingly, the stop portions 115 inhibit further tilting of the stool 100 along the rocking paths R1, R2, R3.

Figure 4:
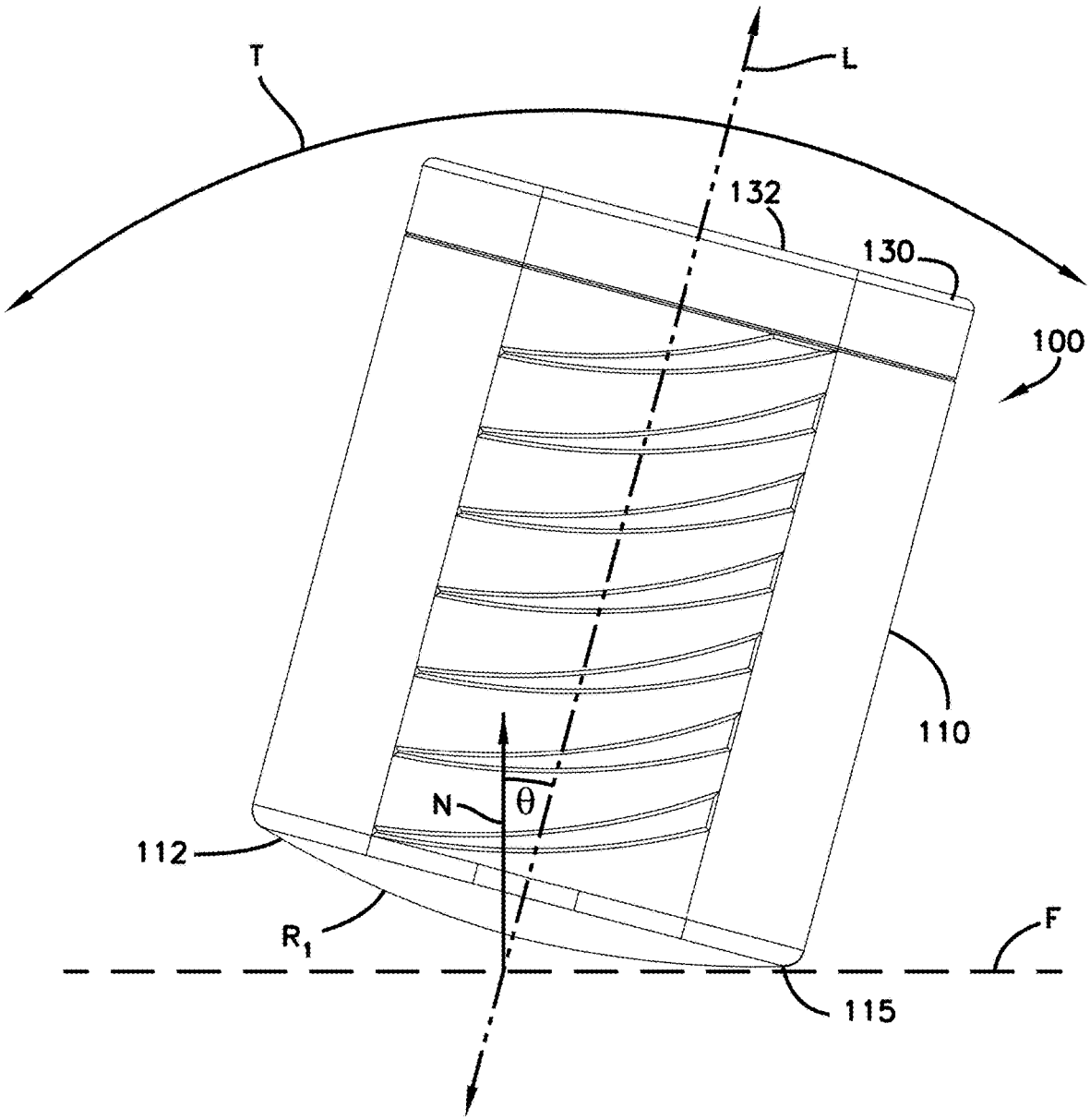
FIG. 4 is a first side elevational view of the active stool of FIG. 1 tilted along a first rocking path in a first direction.
Figure 5:
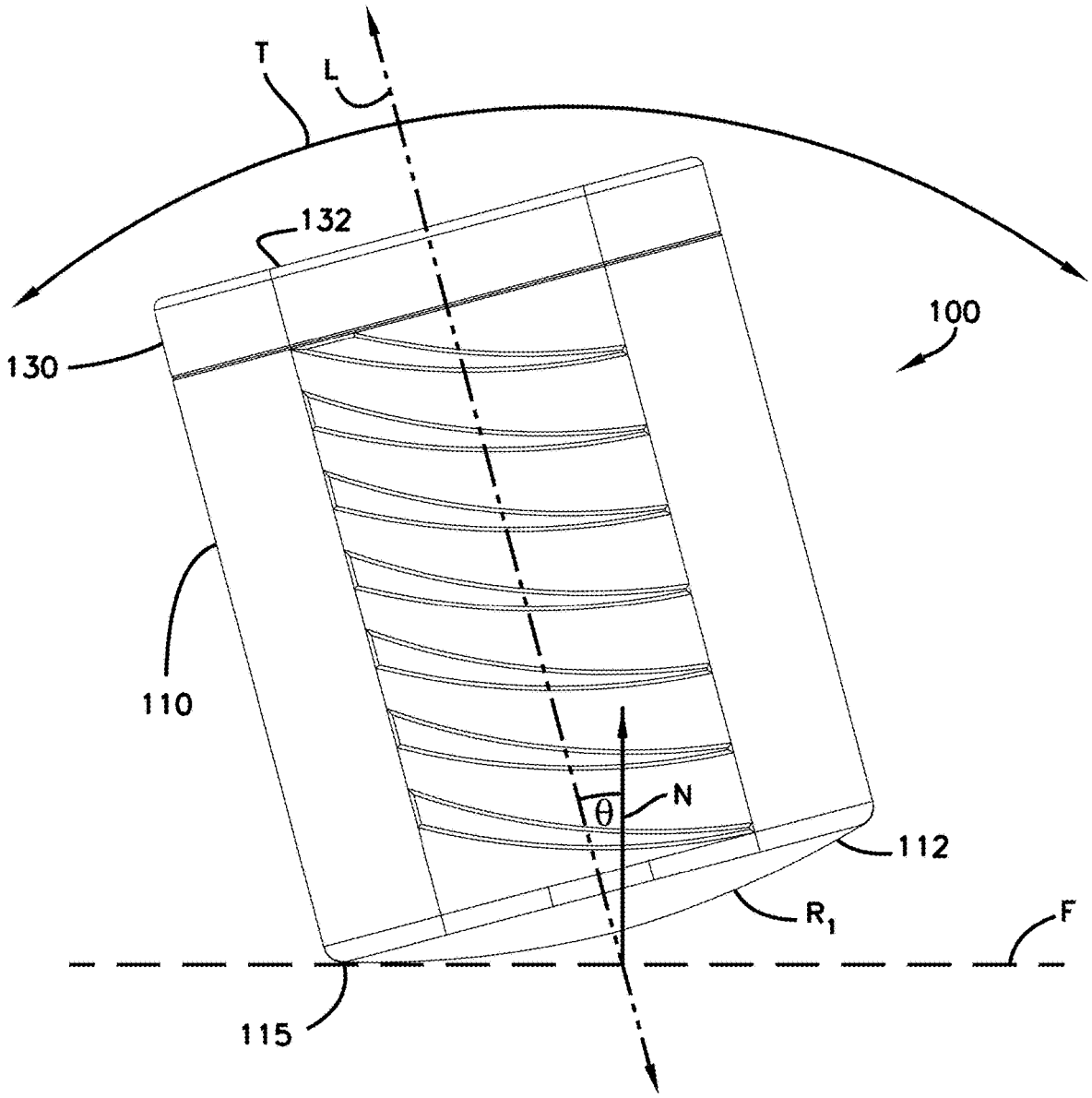
FIG. 5 is a first side elevational view of the active stool of FIG. 1 tilted along the first rocking path in a second direction.

As shown in FIGS. 4 and 5, as the stool 100 tilts along the rocking path R1, there is a change in angle θ between the longitudinal axis L of the stool 100 and a reference axis N normal to a floor F on which the stool 100 is disposed. In certain implementations, the convex surface 112 allows the stool 100 to tilt up to an angle θ of 45 degrees in either direction along the rocking path R1. In certain implementations, the convex surface 112 allows the stool 100 to tilt up to an angle θ of 40 degrees in either direction along the rocking path R1. In certain implementations, the convex surface 112 allows the stool 100 to tilt up to an angle θ of 35 degrees in either direction along the rocking path R1. In certain implementations, the convex surface 112 allows the stool 100 to tilt up to an angle θ of 30 degrees in either direction along the rocking path R1. In certain implementations, the convex surface 112 allows the stool 100 to tilt at an angle θ of between about 5 degrees and about 45 degrees in either direction along the rocking path R1. In certain implementations, the convex surface 112 allows the stool 100 to tilt at an angle θ of between about 10 degrees and about 35 degrees in either direction along the rocking path R1. In certain implementations, the convex surface 112 allows the stool 100 to tilt at an angle θ of between about 15 degrees and about 25 degrees in either direction along the rocking path R1.

Figure 6:
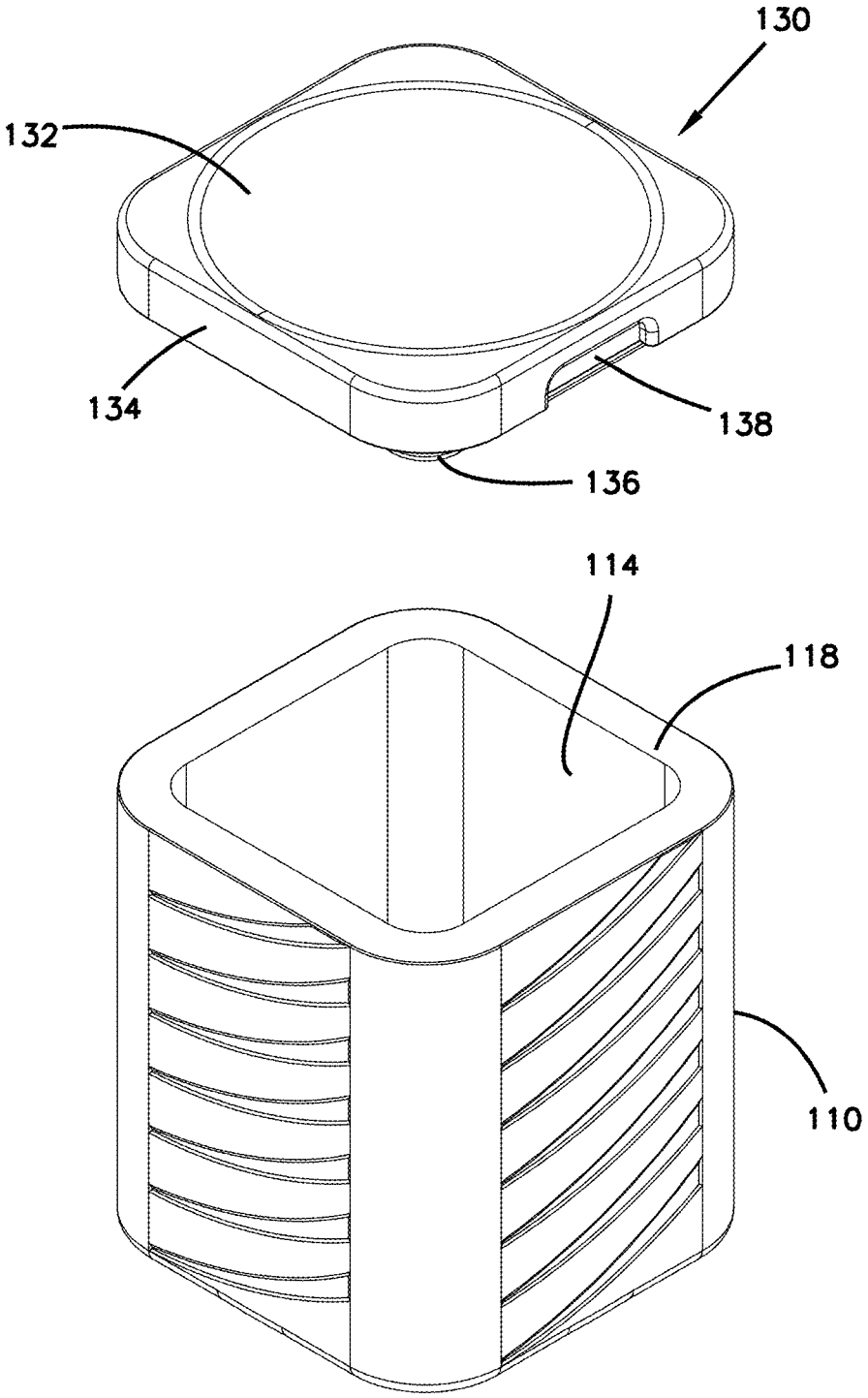
FIG. 6 is a perspective view of the active stool of FIG. 1 with the top exploded away from the base.

As shown in FIG. 6, the active stool 100 includes a base 110 and a cover 130. The cover 130 defines the seat 132. In some implementations, the base 110 defines the convex surface 112. In other implementations, the convex surface 112 is a separate piece that attaches to the base 110. In certain examples, a gasket or other liner is disposed between the base 110 and the cover 130.

Figure 7:
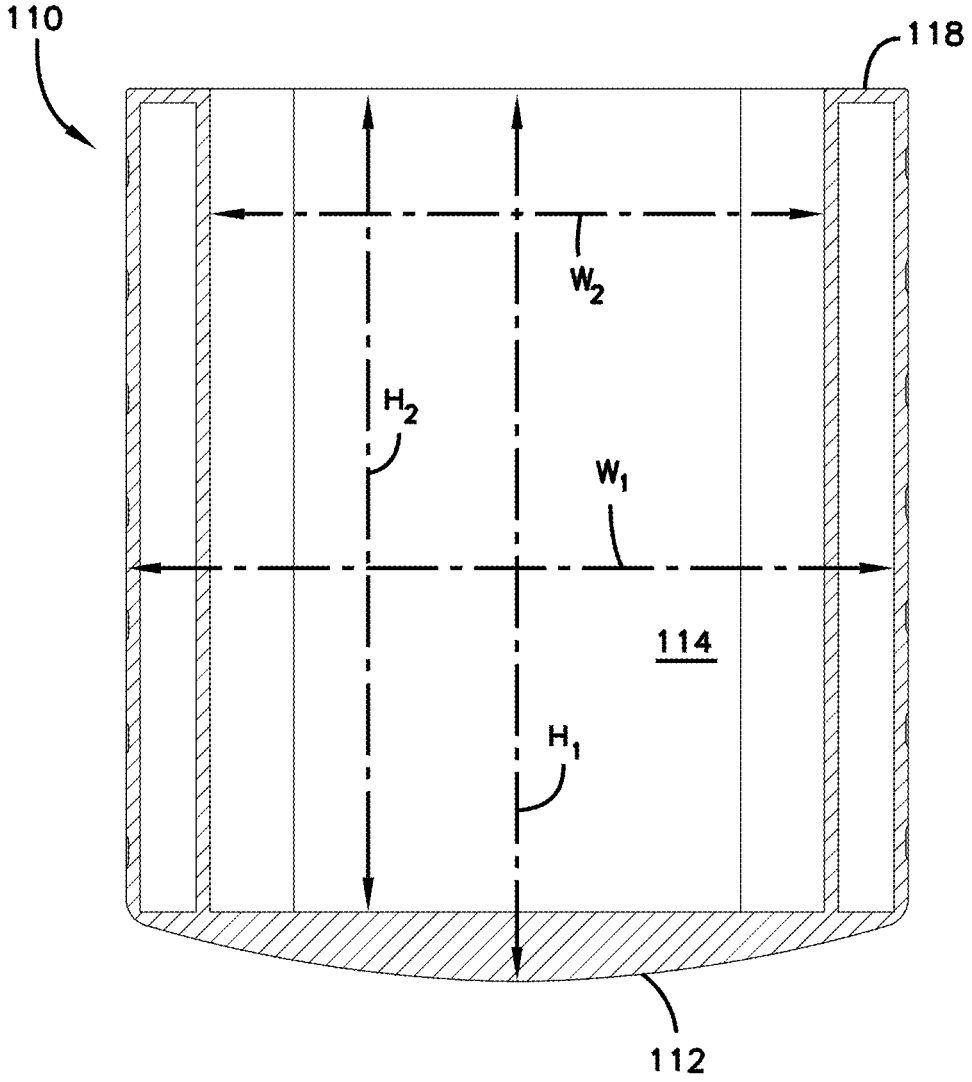
FIG. 7 is a cross-sectional view of the base of the active stool of FIG. 1 with the cover removed.
Figure 8:
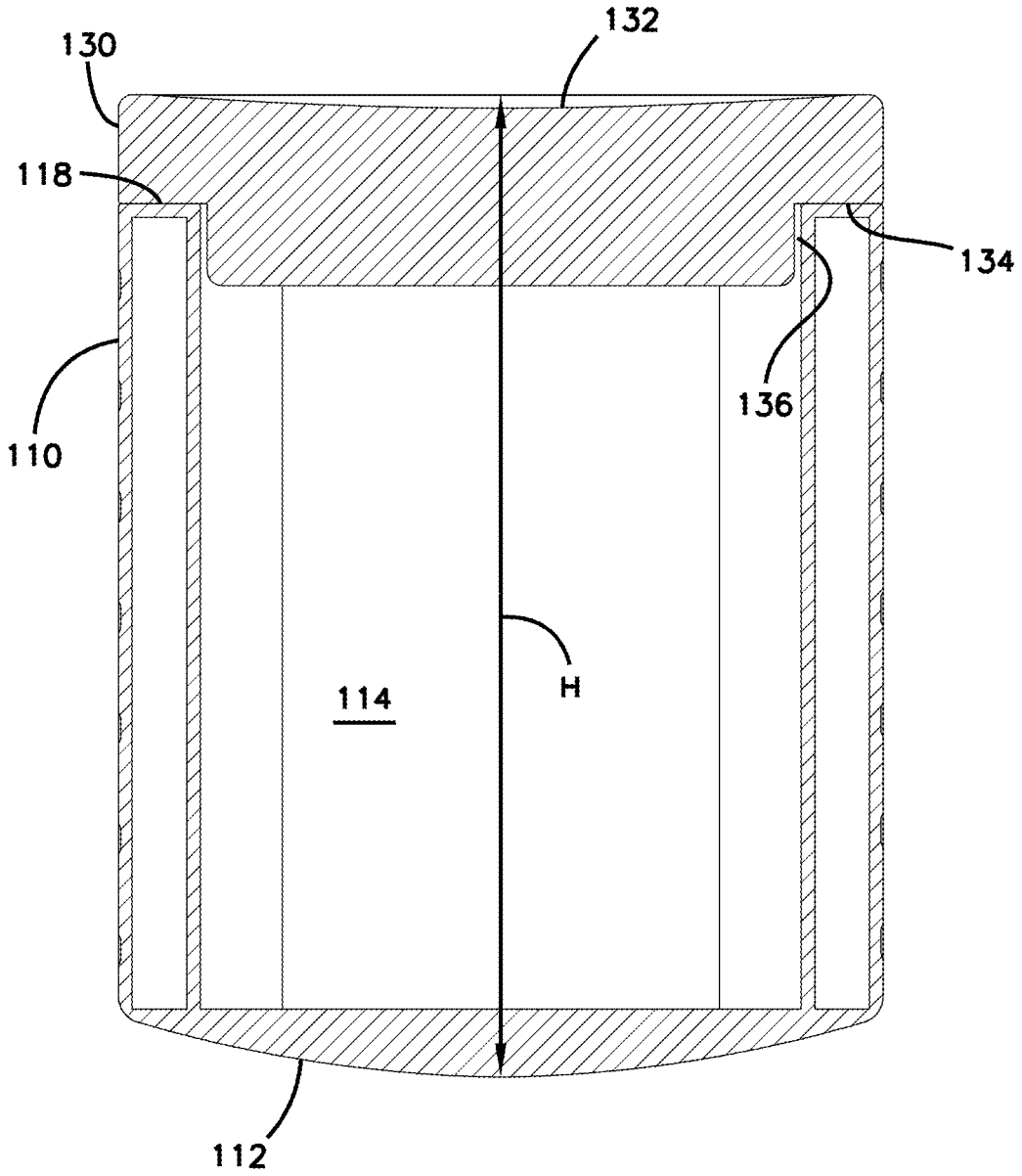
FIG. 8 is a cross-sectional view of the active stool of FIG. 1.

As shown in FIGS. 6-8, the base 110 defines a cavity 114 accessible through an open end 116 of the base 110. In certain implementations, the open end 116 of the base 110 is located opposite the convex surface 112. In certain implementations, a rim 118 surrounds the open end 116 of the cavity 114. When the cover 130 is mounted to the base 110, the cover 130 rests on the rim 118 as will be described in more detail herein.

In certain implementations, the cavity 114 extends within a majority of the base 110. In certain examples, a cross-sectional area of the cavity 114 has a common shape with a cross-sectional area of the base 110. In certain examples, a cross-sectional area of the cavity 114 extends over a majority of a cross-sectional area of the base 110. In certain examples, the cavity 114 has a height H2 that extends along a majority of a height H1 of the base 110 (see FIG. 7). In certain examples, the cavity 114 has a width W2 that extends along a majority of a width W1 of the base 110 (see FIG. 7). In certain examples, the cavity 114 has a depth that extends along a majority of a depth of the base 110. In certain examples, the width and the depth of the cavity 114 are the same. In certain examples, the height H2 of the cavity 114 is greater than the width W2 and greater than the depth.

In certain examples, the width W2 of the cavity 114 is between about eight inches and twenty-four inches. In certain examples, the width W2 of the cavity 114 is between about nine inches and twenty inches. In certain examples, the width W2 of the cavity 114 is between about ten inches and eighteen inches. In certain examples, the width W2 of the cavity 114 is between about eleven inches and sixteen inches. In certain examples, the width W2 of the cavity 114 is about eleven inches. In certain examples, the width W2 of the cavity 114 is about twelve inches.

In certain examples, the height H2 of the cavity 114 is at least twelve inches. In certain examples, the height H2 of the cavity 114 is at least fourteen inches. In certain examples, the height H2 of the cavity 114 is at least sixteen inches. In certain examples, the height H2 of the cavity 114 is at least seventeen inches. In certain examples, the height H2 of the cavity 114 is about eighteen inches. In certain examples, the height H2 of the cavity 114 is about twenty inches. In certain examples, the height H2 of the cavity 114 is between about twelve inches and about thirty-six inches. In certain examples, the height H2 of the cavity 114 is between about fourteen inches and about thirty inches. In certain examples, the height H2 of the cavity 114 is between about sixteen inches and about twenty-four inches.

As shown in FIGS. 6 and 8, the cover 130 is configured to mount to the base 110 to close the open end 116 of the base 110. The cover 130 includes a cap 134 that is sized to extend over the rim 116 of the base 110. In certain examples, a bottom protrusion 136 extends downwardly from the cap 134. The bottom protrusion 136 is sized to fit within the cavity 114 of the base 110 (see FIG. 8). In certain examples, the bottom protrusion 136 is sized to fit snugly with the cavity 114 to inhibit lateral movement of the cover 130 relative to the base 110.

In certain examples, the cover 130 includes one or more handles 138 to facilitate removing the cover 130 from the base 110 and positioning the cover 130 at the base 110. In some examples, the handles 138 are recessed into the cap 134 (e.g., see FIG. 6). In other examples, the handles 138 protrude from the cap 134. In some examples, the handles 138 are integral with the cover 130. In other examples, the handles are separate pieces (e.g., straps, pulls, knobs, etc.) attached to the cover 130.

The cover 130 defines the seat 132 for the user. The seat 132 faces away from the cavity 114 when the cover 130 is mounted to the base 110. In the example shown, the seat 132 is defined by a depression within the cap 134 (e.g., see FIG. 8). In other examples, the seat 132 may be planar with the cap 134 or may even protrude from the cap 134. In certain examples, the seat 132 is symmetrical so that a user may sit on the seat 132 in any desired rotational orientation (i.e., facing any of 360 degrees around the longitudinal axis L of the stool 100). In the example shown, the seat 132 is formed by a concave depression in the cap 134. In certain implementations, the seat 132 extends over a majority of a cross-sectional area of the cover 130.

Having described the preferred aspects and implementations of the present disclosure, modifications and equivalents of the disclosed concepts may readily occur to one skilled in the art. However, it is intended that such modifications and equivalents be included within the scope of the claims which are appended hereto.

What is claimed is:

1. An active stool comprising:

a base defining an interior cavity accessible through an open end of the base, the interior cavity extending along a majority of a height of the base, the base being configured to tilt along at least one rocking path; and a cover removably mountable to the base to cover the open end, the cover defining a seat facing away from the interior cavity when the cover is mounted to the base.

2. The active stool of claim 1, wherein the seat is formed by a depression defined in the cover.

3. The active stool of claim 2, wherein the depression is concave.

4. The active stool of claim 1, wherein the seat extends over a majority of a cross-sectional area of the cover.

5. The active stool of claim 1, wherein the cover includes handles.

6. The active stool of claim 5, wherein the handles are recessed into sides of the cover.

7. The active stool of claim 1, wherein a cross-sectional area of the interior cavity extends over a majority of a cross-sectional area of the base.

8. The active stool of claim 1, wherein the base defines a spherical cap opposite the open end.

9. The active stool of claim 1, wherein the base is configured to tilt along a plurality of rotationally offset rocking paths.

10. The active stool of claim 1, wherein the interior cavity of the base is partially bounded by a pair of opposing flat sides.

11. A storage device comprising:

a base extending between a first end and a second end, the first end defining a convex surface, the base defining an interior cavity accessible through an aperture at the second end, the interior cavity having a cross-sectional area that extends over a majority of a cross-sectional area of the base; and a cover removably mountable to the base at the second end to cover the aperture.

12. The storage device of claim 11, wherein the base has a height extending between the first and second ends, and wherein the interior cavity extends along a majority of the height of the base.

13. The storage device of claim 11, wherein a cross-sectional area of the interior cavity has a common shape with a cross-sectional area of the base.

14. The storage device of claim 13, wherein the convex surface has a circular cross-dimension.

15. The storage device of claim 13, wherein the convex surface is shaped as a spherical cap.

16. The storage device of claim 11, wherein the base has a square cross-sectional area.

17. The storage device of claim 16, wherein the cover has a square cross-sectional area.

18. The storage device of claim 11, wherein the base has an oblong cross-sectional area.

19. The storage device of claim 18, wherein the cover has an oblong cross-sectional area.

* * * * *